United States Patent [19]

Henderson

[11] Patent Number: 4,550,739

[45] Date of Patent: Nov. 5, 1985

[54] PIPE TAMPING TOOL

[75] Inventor: George H. Henderson, Lennon, Mich.

[73] Assignee: G.E.M.M. Manufacturing, Vernon, Mich.

[21] Appl. No.: 497,079

[22] Filed: May 23, 1983

[51] Int. Cl.[4] ..... A24F 3/02; A24F 9/10; A24F 9/14

[52] U.S. Cl. ..... 131/247; 131/243; 131/245; 131/246; 131/257; 131/260

[58] Field of Search ..... 131/184 R, 184 A, 184 B, 131/247, 260, 259, 257, 258, 329, 243, 245, 246; D27/5, 6, 51

[56] References Cited

U.S. PATENT DOCUMENTS

| | | | |
|---|---|---|---|
| D. 107,147 | 11/1937 | French | 131/260 |
| 994,913 | 6/1911 | Elliott | 131/26 |
| 1,519,955 | 12/1924 | Ciulla et al. | 131/260 |
| 1,648,454 | 11/1927 | Goetz | 131/260 |
| 1,883,178 | 10/1932 | Wills | 131/247 |
| 2,041,469 | 5/1936 | Haas | 131/260 |
| 2,289,192 | 7/1942 | Hansen . | |
| 2,592,401 | 4/1952 | Enssle | 131/260 |

*Primary Examiner*—V. Millin

*Attorney, Agent, or Firm*—Basile, Weintraub & Hanlon

[57] ABSTRACT

A pipe tamping tool 10 includes tamping member 26 integrally formed with cleaning member 28 capable of cleaning the interior of the bowl of the pipe. Medially formed on the cleaning member 28 is a reacting member 30 for retaining the pipe bowl in an upright position when placed upon a horizontal surface. The retaining member 30 is a substantially arcuate member which envelopes the stem of the pipe and which has outwardly flaired free edges or legs or flanges which radiate outwardly from the arcuate portion thereof. A clip 42 for attaching the device to an article of clothing, is integrally formed as part of the device. A flocking or similar material 40 can be adhered to the interior of the arcuate member 36 to prevent scratching of the pipe stem.

5 Claims, 3 Drawing Figures

PIPE TAMPING TOOL

BACKGROUND OF THE INVENTION

1. Field of the Invention

The present invention pertains to assistance devices for pipe smokers. More particularly, the present invention pertains to tamping devices to assist pipe smokers. Even more particularly, the present invention concerns a combined tamping and bowl cleaning device for use by pipe smokers.

2. Prior Art

The prior art has proposed various devices to assist the pipe smoker in both tamping the tobacco maintained within the bowl as well as for cleaning the bowl, itself. See, inter alia, U.S. Pat. Nos. 1,648,454; 1,519,955; 3,263,690; 2,041,469 and U.S. Pat. No. Des. 107,147.

Inherently, the prior art devices are intended to be carried by the pipe in some manner.

However, even when the devices of the prior art are incorporated with and/or carried by the pipe, per se, there is still the inherent problem of maintaining the bowl in an upright position when not in use. As is known to those skilled in the art to which the present invention pertains, ordinarily, when a pipe is placed at rest it is either placed in a stand or it must be held in an upright position. This is extremely disadvantageous, especially, when the pipe has been in use for a considerable period of time and the heat generated thereby makes it difficult to hold. This is also true during normal usage of the pipe. The art has, heretofore, previously proposed solutions to alleviate this. See, for example, U.S. Pat. Nos. 994,913 and 1,883,178. However, these prior art devices are unable to incorporate other pipe smoking accountrements thereinto.

The present invention, as will subsequently be detailed, provides a device which both assists in the tamping of tobacco within the bowl of the pipe as well as in cleaning the bowl, while, at the same time, providing a means whereby the pipe bowl can be maintained in a vertical orientation when not in use.

SUMMARY OF THE INVENTION

In accordance with the present invention there is provided a pipe tamping tool comprising an integrally formed member including: (a) means for tamping the contents of a bowl of a smoker's article, (b) means for scraping or cleaning the bowl of a smoker's article and (c) means for retaining or maintaining the bowl in a vertical orientation when the smokers article is placed upon a horizontal surface.

The instant device further comprises a clip integrally formed as part of the device which detachably mounts the device to an article of clothing of a user, such as to a pocket or the like.

As noted hereinabove, the device is fabricated as an integral member and may further include a flocking or similar soft material which is bonded to the means for maintaining the bowl in the upright vertical position to prevent scratching of the smoker's article.

As contemplated by the present invention, the smokers article is a pipe. In use, the device hereof is mounted to the stem of the pipe.

For a more complete understanding of the present invention reference is made to the following detailed description and accompanying drawing. In the drawing like reference characters refer to like parts throughout the several views in which:

DETAILED DESCRIPTION OF THE PREFERRED EMBODIMENT

Figure 1:
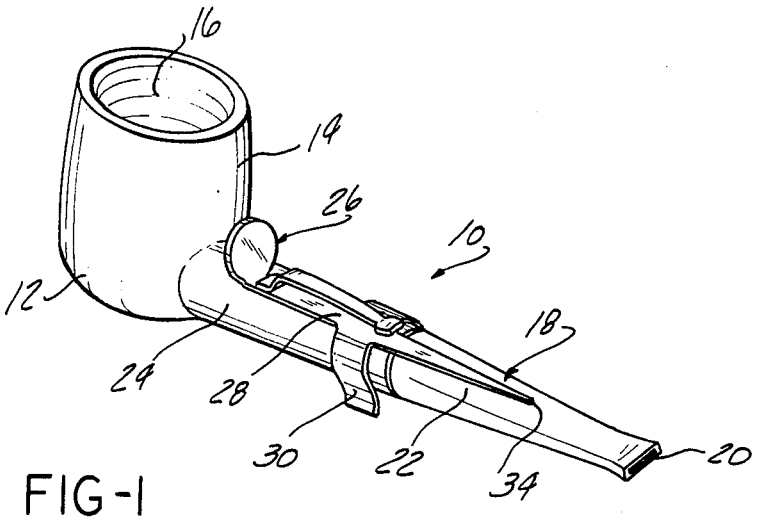
FIG. 1 is a perspective view showing the device, in use, mounted onto the stem of a pipe.
Figure 2:
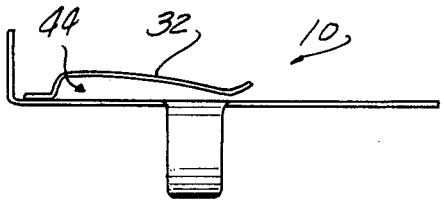
FIG. 2 is a side-elevational view of the device of the present invention.
Figure 3:
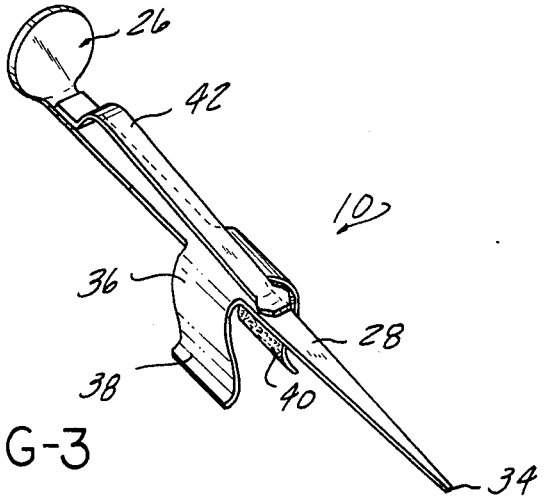
FIG. 3 is a perspective view of the device hereof.

Now, and with reference to the drawing, there is depicted therein a pipe tamping tool in accordance with the present invention and generally indicated at 10. The tool hereof is intended to be used in conjunction with a smoker's article, such as a pipe 12. The pipe 12, as is known to those skilled in the art to which the present invention pertains, generally comprises a bowl 14 having a hollow interior 16 in which is implaced tobacco or other similar smoking material. A stem 18 is integrally formed with the bowl 16 and is in fluid communication therewith to enable smoke drawn from the tobacco to travel through the stem and out of the mouthpiece 20 formed at the free end of the stem 18. Conventionally, the stem comprises at least two separable portions 22 and 24. It is to be understood with respect hereto that the construction and configuration of the pipe, per se, does not form a part of the instant invention. Rather, the pipe is the environment in which the present invention is used.

Referring, again, to the drawing the device 10 generally comprises means for tamping a quantity of tobacco 26 or similar smoking material which is maintained within the bowl 14. The device further includes means for scraping or cleaning the bowl 28 which is integrally formed with the means for tamping 26.

Means for retaining or maintaining the bowl in a vertical orientation 30 is integrally formed with the means 28. The means 30, as will subsequently be detailed, maintains the pipe bowl in the vertical orientation when the pipe is placed upon a horizontal surface.

The present invention further contemplates a retaining clip 32 for securing the device 10 to an article of apparel of a user, such as within a pocket or the like.

More specifically, the means for tamping 26 comprises a planar member, generally disc-shaped, which is dimensioned and adapted to be inserted into the interior 16 of the bowl 14 for tamping tobacco therewithin, in a conventional manner.

The means 28 is integrally formed with the means 26 and is disposed substantially normal or perpendicular thereto. The means 28 comprises an elongated flat, planar member which is tapered in such a manner that its widest width is at the junction between itself and the disc-shaped member 26. The free or opposite end 34 terminates, substantially, at a point. In use, the member 28 is used to scrape the sides and bottom of the bowl to remove ash and other tar-like deposits from the interior 16 of the bowl 14. Also, the means 26 is used to loosen and dislodge tamped, spent tobacco within the interior 16 of the bowl 14. This is done by using the pointed end 34 to loosen the tobacco by inserting it a few times into the tobacco.

The means for maintaining the bowl in a vertical orientation 30, as shown, is disposed substantially medially of the means 28. The means 30 comprises a substantially arcuate member 36 which is dimensioned to envelope the stem 18 of the pipe 12, as shown. Each opposed, free end of the means 30 has a flange 38 integrally formed therewith which radiates outwardly from the arcuate member 36. The outward flair of the flanges or legs 38, enables the flanges to engage a horizontal surface, such as a table or the like, in a manner such as to enable the bowl to remain in a vertical or upright position. Thus, the outward flair to the legs is of critical importance hereto to enable the means 30 to function in its proper manner.

In order to avoid scratching of the pipe stem or the like, a flocking or soft backing 40 is adhered by bonding, glueing or the like to the interior surface of the means 30. Any conventional glue can be employed herein. The flocking can be felt or other similar material.

The present invention further comprises a retaining clip 42 which enables attachment of the device to an article of apparel of a user, such as a pocket or the like. The clip comprises an elongated member configured in an irregular pattern which defines a space between itself and the means 28 to define a gap 44 therebetween.

The clip 42 is formed from a bent unitary member having its first end disposed proximate the junction between the means 26 and the means 28 and secured thereto such as by welding or the like. The member, then, has a first bend formed therein substantially normal to the member 28 and parallel to the means 26. The clip is, then, formed with a second bend which is slanted downwardly toward the member 28, toward the end 34 thereof, as shown. The clip, then, tangentially engages the member 28 proximate the free end thereof, as shown. The terminous or free end of the clip is then bent upwardly therefrom. The clip 32 is formed from a spring-like material to enable it to be displaced from the tangential position. This permits the clip to cooperate with the member 28 to sandwich an article of apparel of the user, therebetween, such as a pocket, in a manner well known to the skilled artisan.

The instant device is employed by mounting it about the stem of the pipe, via the means 30. The device remains thereon until ready for use in tamping or scraping, whereupon it is removed from the stem and the desired function is carried out, i.e. tamping the tobacco by grasping the member 28 or scraping the bowl, loosening tobacco, etc., again, by engaging the member 28 with the tobacco or with the sides or bottom of the bowl.

During use, the pipe can be placed upon a horizontal surface and the outwardly flaired legs 38 of the means 30 engage the horizontal surface to maintain the bowl in an upright position.

In forming and fabricating the instant device, it can be formed from any suitable material, such as brass, or other non-heat conducting metal. Likewise, the device can be formed from a suitable plastic material by any suitable method, such as by injection molding or the like.

It should be noted with respect hereto that, optimally, the device is formed from a non-heat conducting material. This enables the smoker to merely grasp the device during smoking to prevent injury to the fingers caused by burning or the like when the bowl of the pipe becomes too hot.

Where the device is formed from a conductive material, such as brass, by displacing the device from the bowl, heat conduction is avoided.

When the pipe is not in use and easy access is desired, it can be stored in the pocket of a user by merely retaining the device on the stem and clipping it to the article of apparel of the user, via the clip 42.

It is to be appreciated from the preceeding that there has been described herein a pipe tamping tool which affords universal usage to the pipe smoker.

Having, thus, described the invention what is claimed is:

1. A pipe tamping tool, comprising:

(a) means for tamping tobacco within a bowl of a pipe;

(b) means for cleaning the interior of a bowl of a pipe; and (c) means for retaining a bowl of a pipe in a vertical position when a pipe is placed upon a horizontal surface, the means for retaining comprising:

(1) an arcuate member having an arc less than 360° and which envelopes the stem of a pipe; and (2) a leg formed at each free end of the arcuate member and which radiates outwardly therefrom.

2. The tool of claim 1 wherein:

the means for tamping comprises a disc-shaped planar member, the means for cleaning comprises an elongated planar member disposed substantially normal to the means for tamping, and the means for retaining is disposed substantially medially of the means for cleaning.

3. The tool of claim 1 which further comprises:

scratch-preventing material adhered to the means for retaining about the portion thereof which engages the stem of a pipe.

4. The tool of claims 1 or 2 which further comprises:

a clip mounted onto the means for cleaning for removably mounting the tool to an article of apparel of a user.

5. The tool of claims 1, 2 or 3 wherein:

the tool is formed from a non-heat conducting material.

* * * * *